US006309475B1

(12) United States Patent
Takayama et al.

(10) Patent No.: US 6,309,475 B1
(45) Date of Patent: Oct. 30, 2001

(54) ROLLING ELEMENT AND PRODUCING METHOD

(75) Inventors: Takemori Takayama; Chikara Nakao, both of Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/237,233

(22) Filed: Jan. 26, 1999

(30) Foreign Application Priority Data

Jan. 30, 1998 (KR) ..... 10-033774

(51) Int. Cl.[7] ..... C23C 8/22; C23C 8/26; C23C 8/32; C21D 9/32; C21D 9/36

(52) U.S. Cl. ..... 148/232; 148/233; 148/218; 148/219; 148/226; 148/906; 148/318; 148/319; 384/912; 384/492

(58) Field of Search ..... 148/906, 318, 148/319, 225, 230, 226, 232, 233, 218, 219; 384/492, 912

(56) References Cited

FOREIGN PATENT DOCUMENTS 5-195161 8/1993 (JP) .
7-207412 8/1995 (JP) .
10-176219 6/1998 (JP) .

*Primary Examiner*—Deborah Yee
(74) *Attorney, Agent, or Firm*—Armstrong, Westerman, Hattori, McLeland & Naughton, LLP

(57) ABSTRACT

For easily producing a toothed material for high-strength gears etc. with a plastic working technique, deformation resistance occurring in plastic working is reduced and stable high precision plastic working is enabled at lower temperatures. One or more types of heat treatment selected from carburization, carbonitriding and nitriding and a hardening process are applied to an alloy steel material containing: iron as a main component; at least 1.0 to 4.5 wt % Si; 0.35 wt % or less C; and balance Fe and unavoidable impurities, whereby a rolling element is obtained which has a surface layer mainly composed of martensite containing no α-Fe phase and of residual austenite and an inner structure cooled from an (α+γ)-Fe two phase region.

11 Claims, 23 Drawing Sheets

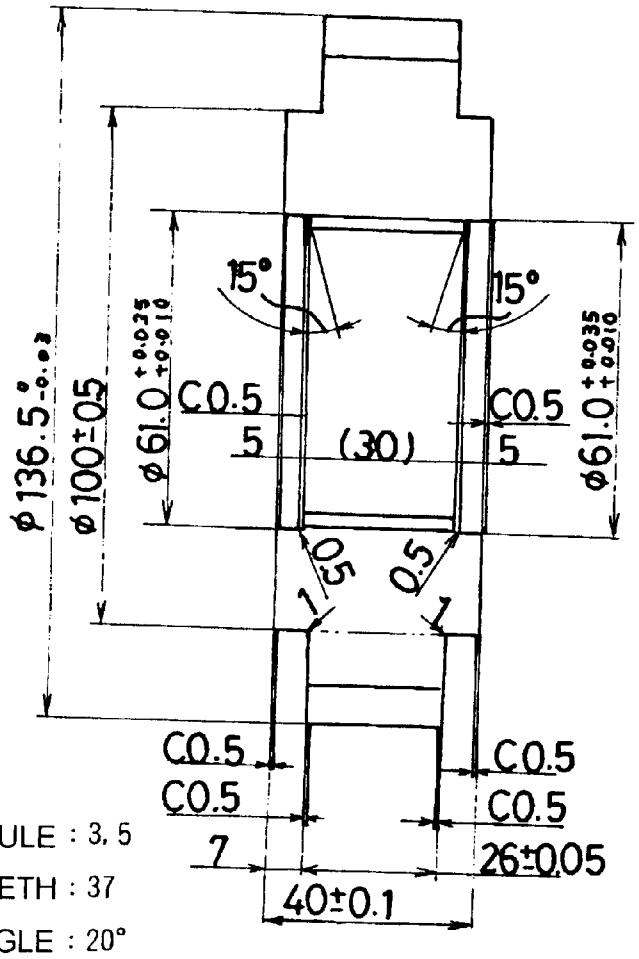
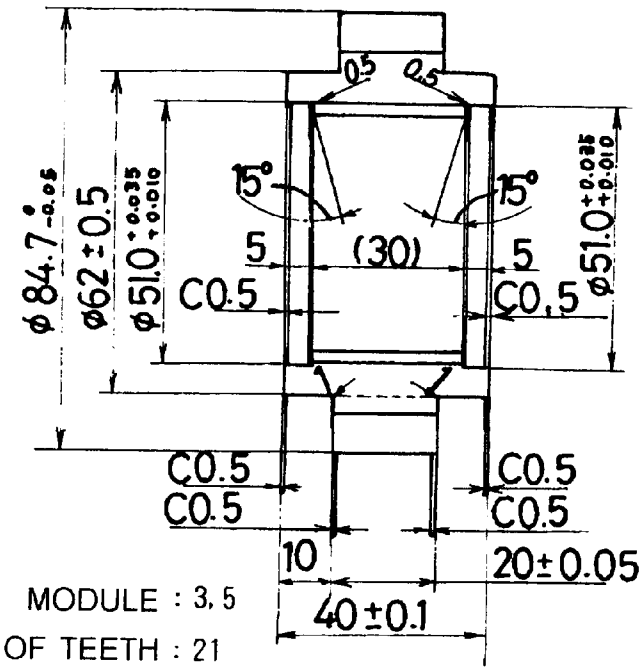
FIG. 13

METALLOGRAPHIC STRUCTURE OF CRYSTAL GRAINS OF MATERIAL No. 1
AFTER ONE - HOUR HEATING AT 1,100 °C
(WHITE: α-Fe PHASE, BLACK: MARTENSITE (PRIOR AUSTENITE))

HEAT TREATMENT PATTERN FOR CARBURIZATION AND CARBONITRIDING TEST 1

METALLOGRAPHIC STRUCTURE OF SURFACE OF MATERIAL No. 3 AFTER NITRIDING AT 850°C WITH HEAT TREATMENT PATTERN SHOWN IN FIGURE 15

METALLOGRAPHIC STRUCTURE OF SURFACE OF MATERIAL No. 3 SUBJECTED TO ROLLER PITTING TEST AFTER NITRIDEING AT 850°C WITH HEAT TREATMENT PATTERN SHOWN IN FIGURE 15

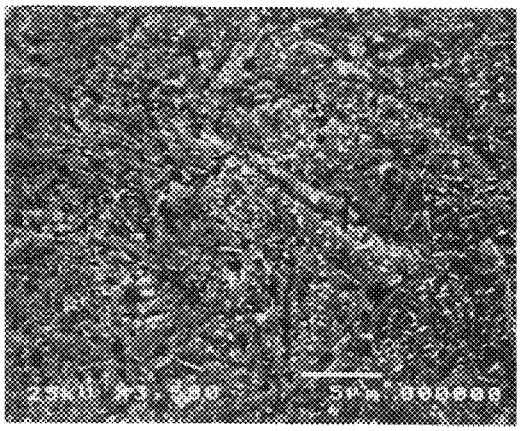

FIG. 17(a) REGION 50 μm FROM SURFACE

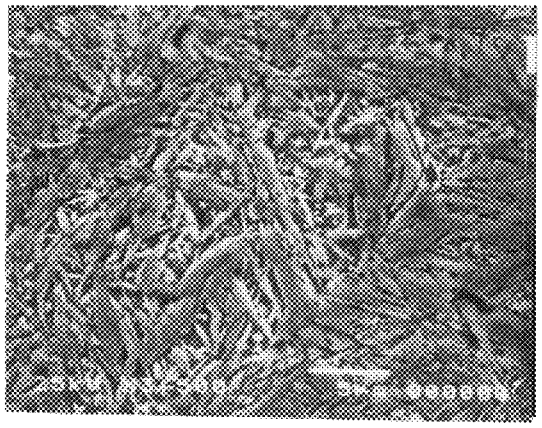

FIG. 17(b) REGION 400 μm FROM SURFACE (a) MARTENSITE CREATED FROM DISPERSEDLY PRECIPITATED AlN AND RESIDUAL AUSTENITE IS FINE
(b) MARTENSITE IS COARSE IN AREA WHERE AlN IS NOT DISPERSEDLY PRECIPITATED

HEAT TREATMENT PATTERN FOR CARBURIZATION AND CARBONITRIDING TEST 2

METALLOGRAPHIC STRUCTURE OF SURFACE LAYER OF MATERIAL No. 4
AFTER VACUUM CARBURIZATION (1,050 °C)

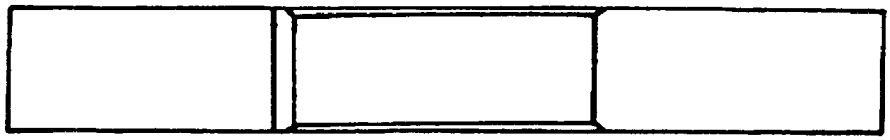
FIG. 21(b) LARGE ROLLER SPECIMEN
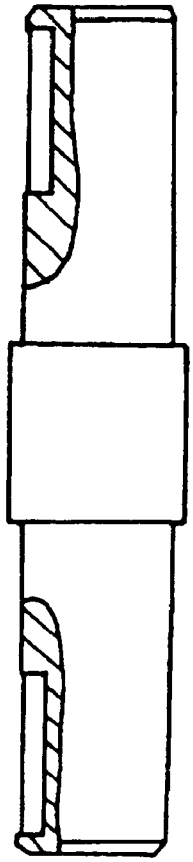
FIG. 21 (a) SMALL ROLLER SPECIMEN

ROLLING ELEMENT AND PRODUCING METHOD

TECHNICAL FIELD

The present invention relates to a method for producing a rolling element such as high strength gears, by applying surface heat treatment such as carburization and carbonitriding to material having excellent plastic workability. The invention also relates to rolling elements produced with such a method.

BACKGROUND ART

In the field of gears for use in automobiles and construction machines, there has recently been an increasing demand for cost reductions by less processing time and for improved surface pressure bearing strength intended for manufacture of compact power transmission systems. With a view to reducing processing time, high precision cold forging is under study, because where blank material is produced by conventional hot forging, dimensional tolerance is so poor that a lot of cutting work is required in the subsequent process of machining. For improving surface pressure bearing strength, there have been made several attempts which include positive addition of Mo element with the intention of improving the resistance of steel to softening caused by tempering. Another attempt is the method in which a material is quenched after carburization and carbonitriding and then subjected to shot peening, whereby the hardness of the surface layer is increased and noticeable compressive residual stress is imparted to the material.

In the method in which the teeth of a gear is formed by hot forging, when γ-phase steel (austenitic steel) heated to 1,200 to 1,300° C. is upset within a forging die at room temperature, the heated steel is rapidly cooled, causing a rapid increase in resistance to deformation, which imposes significant stress on the die or causes significant amount of wear in the die during the formation of elaborate gear teeth. Therefore, the die should be sufficiently rounded to provide an elaborated gear shape and the temperature of the die should be markedly increased to constrain cooling of the blank when contacting with the die. Under such a situation, it is difficult to produce high precision forged blanks for gears. Although it is conceivable that forging speed is increased so that the material blank can be prevented from cooling by the shearing heat of the forging material, this leads to a further increase in the deformation resistance of the material, which arises the need for bigger round die portions and, in consequence, more problems in high precision forging.

More compact gears have smaller tooth profiles and blanks for such gears are more easily cooled, so that the above-described problem becomes more noticeable.

An attempt has been made to form high precision gear teeth by cold forming by use of hot forging material, which however involves two stages, entailing a significant increase in cost.

In the hot forging process described above, since the gear material is once heated to 1,200 to 1,300° C., the crystal grains having the austenitic phase become extremely coarse, and this brings about a significant difference in deformation resistance between the rapidly cooled parts and other parts of the forming material. As a result, there remains irregular processing distortion in the gears. To avoid the distortion of the gears caused by machining and carburization as far as possible, sphering and distortion removal is carried out by cooling or normalizing etc. prior to machining in most cases. This also increases cost.

Warm forging has been proposed taking the above problems into account, in which the steel material is heated to 850 to 1,000° C. which is lower than hot forging temperatures and deformation resistance is reduced with the help of the α phase in order to quickly perform high precision forging while the steel is in the (α+γ)-Fe two phase structure region in the course of the forging operation. However, this method also suffers from the problem that since a heavy deformation process is involved when the α phase precipitates from the γ phase crystal boundary, boundary exfoliation often occurs within the matrix so that the material is likely to be brittle.

To follow the recent trend toward the production of high-power, light-weight and compact reducers and transmissions, improved surface pressure bearing strength is required especially in gears. As explained above, gears are generally manufactured by applying surface heat treatment such as carburization and carbonitriding to material after machining to harden their surface layers and designed so as to withstand high contact pressure (Hertz's surface pressure). Usually, such heat treatment takes long time increasing the production cost of gears. Reduction gears for construction machines have large-sized modules in many cases and RX gas carburization for such gears normally takes a couple of days. Therefore, various methods using high carburization temperatures are now under study. Introduction of high carburization temperatures in RX gas carburization, however, encounters difficulty in controlling the carbon potential of the carburization so as to maintain a $CO/CO_2$ gas equilibrium condition. For instance, in the carburization phase with high carbon potential, coarse cementite precipitates on the surface of the gear material, leading to a decrease in gear strength. With view to preventing the precipitation of cementite, a diffusion process is carried out for a length of time equal to the time required for the carburization phase or more, thereby adequately adjusting surface carbon concentration. This measure, however, cannot overcome the above problem, i.e., the difficulty in performing high-accuracy carbon potential control.

For producing gears capable of withstanding higher contact pressure to follow the aforesaid recent trend, appropriate alloy composition is sought by addition of Mo and/or V to steel material, which increases resistance to softening caused by tempering in the surface hardened layer obtained after quenching, or by addition of Nb and/or Ti to steel material, which makes the crystal grains finer. High-power shot peening is adapted to further harden the surface hardened layer. However, in spite of all efforts, none of the above measures has turned out to be effective.

Positive addition of the elements that form a fine special carbide in austenite such as V, Nb and Ti with view to reinforcement of gears leads to a considerable increase in the deformation resistance of the austenite at high temperatures and therefore such alloy designs are not suitable when taking the above-mentioned plasticity workability into account.

The present invention is directed to overcoming the foregoing problems. Therefore, one of the objects of the invention is to provide a steel material with which deformation resistance generally occurring in plastic working can be reduced and stable high precision plastic working is enabled at lower temperatures, when producing toothed material for high strength gears etc. by simple plastic working instead of machining. Another object of the invention is to provide a method for producing a rolling element such as gears having high surface pressure bearing strength by applying surface heat treatment such as carburization and carbonitriding to the above steel material.

DISCLOSURE OF THE INVENTION

To solve the foregoing problems imposed by hot forging, the invention provides a method wherein plastic working is carried out with low deformation resistance, using a steel material having an alloy composition designed such that, prior to forging, the α-Fe phase and/or (α+γ)-Fe two phase region exists stably in a heated condition in the temperature range of from 800 to 1,300° C. and at least in the range of from 850 to 1,200° C. and such that the amount of the α phase in the (α+γ)-Fe two phase region is 25% by volume during forging. In such forging, even if the steel material is cooled when contacting with the die, the deformation resistance of the material can be prevented from increasing by stabilizing the (α+γ)-Fe two phase region over a wide temperature range, whereby plastic workability can be improved.

The alloy composition designed for allowing the stable existence of the α-Fe phase and/or (α+γ)-Fe two phase region in a heated condition at temperatures ranging from 850 to 1,200° C. prior to forging contains Si and Al which respectively serve as an α phase stabilizing element in a total amount of 1.0 to 4.5 wt % and carbon (γ phase stabilizing element) in an amount of 0.35 wt % or less, the amount of Al being limited to 0.1 to 1.5 wt %.

The crystal grains in the (α+γ)-Fe two phase region when heated to a temperature ranging from 1,100 to 1,300° C. which is more than the maximum temperature (1,000° C.) for restraining the development of the crystal grains of the conventional γ-Fe phase are extremely restrained from developing, compared to the crystal grains of the conventional austenite single phase steels. Accordingly, the problem that the coarsening of crystal grains during the conventional forging/heating process and during high-temperature carburization (described later) can be solved.

Regarding the problem of brittleness presented by the above-described conventional warm forging process, the deformation and stress concentration in the γ phase grain boundary and therefore the exfoliation in the grain boundary can be prevented by setting the state of the material in the early stage of forging in the (α+γ)-Fe two phase region and by adjusting the amount of the α phase at the time of forging to 25% by volume or more.

The quenching distortion, which generally occurs when quenching is carried out subsequently to carburization and/or carbonitriding after forging and machining, can be materially reduced by the inner structures of the surface hardened layer and its lower area which are composed of the αphase. This contributes to the production of high precision gears.

As regarded in the prior art, introduction of high carburization temperatures is regarded as the most effective means for cost savings in carburization in the invention. In the invention, the steel material is prepared to contain Si and Al in a total amount of 1.0 wt % or more whereby precipitation of coarse cementite on the surface of the steel during carburization and carbonitriding is prevented even if carbon potential is A cm concentration or more. The steel is then cooled directly from the high carburization temperature at such a speed that disallows coarse boundary cementite to precipitate in the carburized layer and the steel is then heated again at a temperature lower than the carburization temperature to diffuse and precipitate fine cementite and to fine austenite crystal grains. Thus, a technique for increasing surface pressure bearing strength is established. With this technique, the diffusion process can be omitted from the carburization process, resulting in a considerable reduction in carburization cost. For cooling the steel directly from the high carburization temperature, gas cooling is preferred because it reduces the heat distortion of gears, but the invention achieves this direct cooling by adapting the preferred alloy design which creates the (α+γ)-Fe two phase structure as the inner structure of the carburized layer of the steel as discussed earlier.

For producing parts which are required to exhibit more excellent wear resistance and surface pressure bearing strength, it is effective to precipitate a large amount of fine Cr7C3 during the high-temperature carburization by adding Cr in an appropriate amount. However, when carburization is carried out to produce an ordinary high Cr alloy, Cr7C3 carbide finely precipitates in other areas than the outermost surface of the carburized layer while coarse cementite undesirably precipitating in the outermost surface, which could be a cause to significant brittleness. To cope with this problem, the invention prevents the coarse cementite precipitation by increasing the amount of Si or the amount of Si+Al to 1.5 wt % or more. Taking the stability of the(α+γ)-Fe two phase region into account, the preferable amounts of Si or Si+Al is 2.5 wt % or more. Although the amount of Cr may be determined in view of wear resistance, the upper limit of Cr is determined to be 15 wt % in the invention, because brittleness is more likely to increase when the ratio of the hard diffusion phase is 35% by volume or more.

As a means for increasing the surface pressure bearing strength of rolling elements, a steel material containing Al in an amount of 0.1 to 1.5 wt % is used. Al stabilizes the α-Fe phase like Si and strongly combines with nitrogen which diffusely permeates from the surface in carbonitriding, thereby forming a AlN nitride. By use of such a steel material, AlN having an average grain size of 0.5 μm or less is allowed to dispersedly precipitate in an amount up to about 6% by volume in the surface layer during carbonitriding and/or carburization. With this arrangement, superior characteristics can be obtained. It should be noted that superior surface pressure bearing strength can be achieved by setting the dispersed precipitation depth of AlN to (gear module×0.05) mm or more.

In the invention, in order to increase the surface pressure bearing strength and dedendum strength of gears, carburization and/or carbonitriding is applied substantially according to the conventional gear design criteria to at least ensure a carbon diffusive permeation depth of (gear module×0.15) mm or more.

The amount of carbon used in the diffusive permeation is preferably 0.6 wt % or more (on the basis of surface carbon concentration). In cases where a carbide such as cementite precipitates in the surface layer, the average grain size of the carbide is preferably 3 μm or less and surface carbon concentration is preferably 2.0 wt %.

In cases where a high concentration of Cr is added for dispersing 35% by volume of Cr7C3 carbide, the upper limit of surface carbon concentration is about 4.5 wt %.

Additionally, the alloys arranged according to the invention are improved over the previous case hardening steels in that coarse cementite does not precipitate in the carburization process with a carbon activity of approximately 1 and therefore stable, high concentration carburization with high carbon potential can be ensured. For dispersedly precipitating fine cementite, the arrangement is preferably made such that temperature is once dropped to A1 temperature or less or alternatively to a temperature close to a room temperature after carburization and/or carbonitriding; reheating is then carried out during which cementite is allowed to dispersedly precipitate; and thereafter, hardening is carried out in the condition where non-dissolved cementite remains at the reheating temperature set for hardening.

The steel structure inner than the surface hardened layer of the steel, which is obtained by hardening subsequent to heat treatment such as carburization and carbonitriding, is composed of the α phase and one or more structures selected from pearlite, martensite and bainite. Since the αphase accounts for 25% by volume or more as stated above, it is preferable to increase the strength of the α phase when taking the strength of the matrix into account. In the invention, improvement is achieved by promoting the solid solution of Si and Al in the α-Fe phase. To further strengthen the α phase, it is preferable to increase the amount of martensite and/or bainite. Therefore, alloy elements such as Cr, Mn, Ni and Mo which increase hardenability are added in appropriate amounts.

Cr is an element which stabilizes the α-Fe phase and increases the above-described (α+γ)-Fe two phase region. It also has the functions of noticeably preventing the conversion of cementite into graphite and increasing hardenability. Therefore, Cr may be added in a wide range, but the lower limit for the amount of Cr is preferably 0.3 wt % or more in order to prevent the conversion of cementite into graphite due to a high concentration of Si and Al. The upper limit is preferably 15 wt % or less in view of cost as well as resistance to deformation during plastic working.

Mn and Ni are elements that stabilize the γ-Fe phase and reduce the (α+γ)-Fe two phase region. They are preferably added in an amount of 2 wt % or less in view of hardenability.

Mo is an alloy element having the substantially same function as Cr and contributes to improvements in hardenability and in resistance to softening caused by tempering. In view of cost, it is preferred to add Mo in an amount of 1 wt % or less.

B has little effect on the above phase equilibrium, but it is preferable to add B in view of improved bardenability in the same range as adapted in the conventional boron treatment.

Similarly to Si, V is an element that stabilizes the α-Fe phase and increases the (α+γ)-Fe two phase region. Since it strongly combines with carbon and nitrogen which diffusely permeate during carburization and/or carbonitriding, thereby dispersedly precipitating fine special carbides, nitrides and carbonitrides, the amount of V is preferably restricted to 2 wt % or less.

Zr, Ti and Nb restrain the development of crystal grains when the surface layer of a gear is austenized by the diffusive permeation of carbon and nitrogen in carburization and carbonitriding. Therefore, they are preferably added in amounts within the conventionally adapted range.

Ca, S and Pb are usually added for the main purpose of improving machinability. Therefore, they are preferably added in amounts within the conventionally adapted range.

As described above, a large amount of residual austenite is formed on the quench-hardened surface layer after the diffusive permeation of C and N by carburization, carbonitriding and nitriding. Although the yield of this residual austenite can be controlled by the concentrations of C, N and alloy elements, it is also possible to control it by shot peening or subzero treatment as disclosed in the prior art. It is known that when controlling the amount of residual austenite with these techniques, high compressed residual stress is generated on the surface layer, which contributes to improvements in the bending strength of the dedendum of the gear. Therefore, the shot peening method may be suitably used in the invention.

It is extremely desirable in view of strength that the prior austenite crystal grains on the surface layer are significantly fined to have ASTM grain size #9 or more by applying reheating/quenching to the surface layer in which fine precipitates have been dispersed by carburization, carbonitriding and nitriding as described above.

Another desirable arrangement is such that dense dispersion of fine precipitates such as AlN having an average grain size of 0.5 μm or less is carried out in addition to the above-described fining of the crystal grains, thereby causing significant irregularity in the linearity of the martensite formed from the lenticular martensite plate after hardening and from the residual austenite during rolling, so that the martensite has a width of 1 μm or less on average. With this arrangement, the propagation of fatigue cracks within the grains can be delayed and the stress concentrating on the martensite can be effectively dispersed.

According to the invention, the α-Fe phase and the (α+γ)-two phase region are allowed to be present stably over a wide temperature range by appropriately adjusting the amounts of the basic elements, Si, Al and C, and forgeability is improved by reducing deformation resistance during forging. As a result, the dimension tolerance of the blank obtained after forging can be improved and gears of a substantially near net shape can be manufactured.

Such a blank undergoes carburization and carbonitriding thereby dispersing fine nitrides which mainly includes Al and Cr and then undergoes quenching. The gear thus produced has surface pressure bearing strength 1.4 times or more that of a gear produced by carburizing and quenching of a conventional case hardening steel.

It has been found from the comparison between the distortion amount of a gear obtained after carbonitriding and hardening according to the invention and the distortion amount of a gear obtained by carburizing and hardening of a conventional case hardening steel that the former is highly improved over the latter by virtue of the internal structure of the surface layer which is mostly constituted by the α-Fe phase.

For comparison with a conventional case hardening steel, vacuum carburization was carried out at a temperature as high as 1,100° C. It is found from the result that even if carburization is carried out constantly with a carbon activity of approximately 1 without a substantial diffusion process, the following advantages can be achieved: (i) no coarse cementite precipitates in the surface layer; (ii) surface carbon concentration is high and a stable distribution of carbon concentration can be achieved; and (iii) carburization time can be considerably reduced. In the above case, carburization time can be materially reduced by the process in which steel is once cooled to about a room temperature by gas cooling after carburization, reheating is then carried out to thereby dispersedly precipitate fine cementite, and hardening is carried out. Therefore, heat treatment cost is largely reduced.

BRIEF DESCRIPTION OF THE DRAWINGS

FIG. 13 shows gears for use in a power circulating gear test.

FIGS. 17(*a*) and 17(*b*) show the metallographic structures of the material No. 3 at the surface and at a 0.4 mm depth zone respectively, which material has undergone the heat treatment of FIG. 15 and is being tested by a roller pitting test.

FIGS. 21(*a*) an 21(*b*) shows test pieces used in the roller pitting test.

BEST MODE FOR CARRYING OUT THE INVENTION

Figure 1:
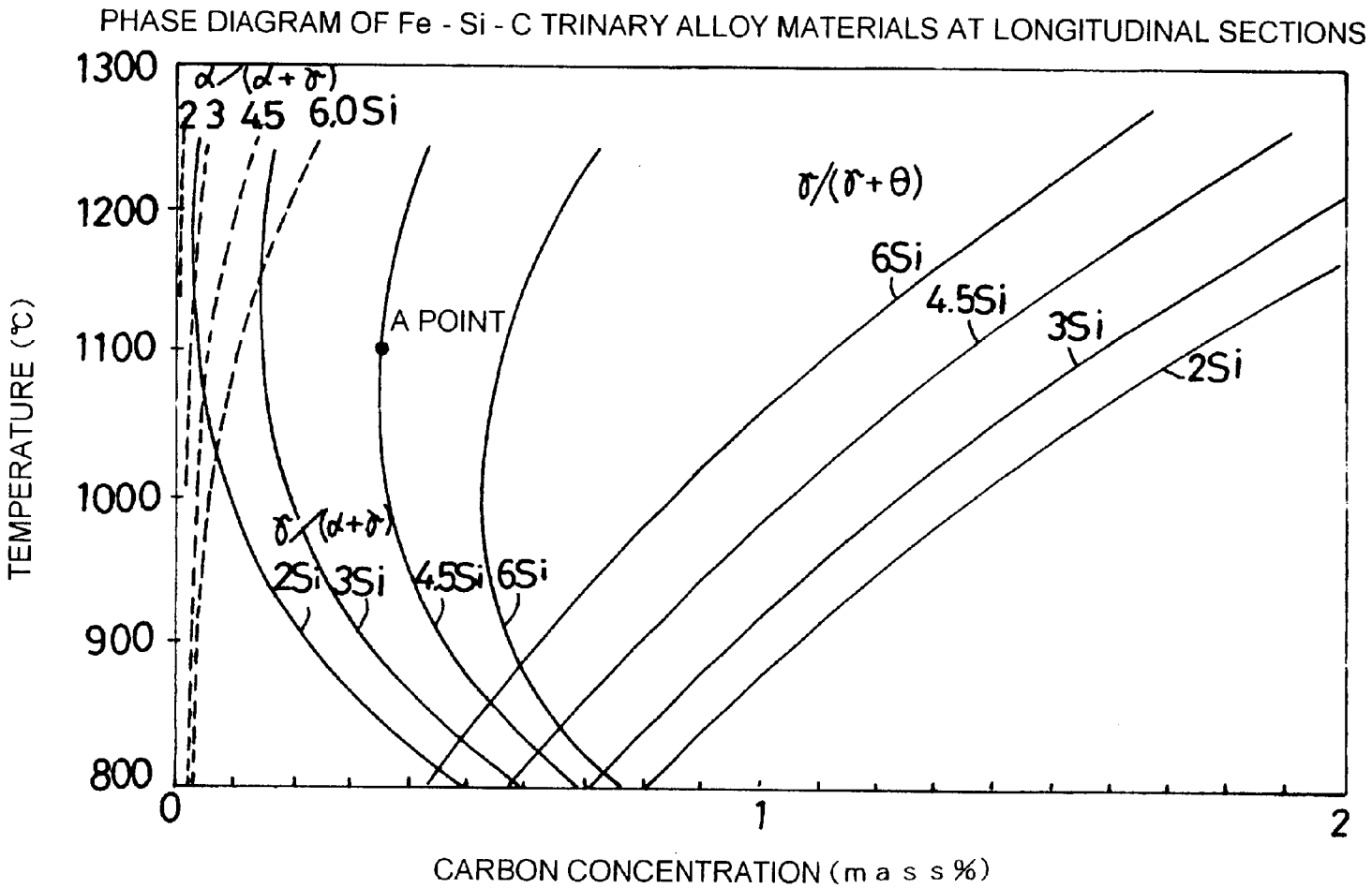
FIG. 1 is a phase diagram showing the states of Fe—Si—C. trinary alloy materials at their respective longitudinal sections.

Referring now to the drawings, rolling elements and their producing methods will be described according to the embodiments of the invention.

[1] Preparation of Steel Material

In designing steel samples used in the invention, the conditions which allow the stable presence of the (α+γ)-Fe two phase region were researched. FIGS. 1 to 10 show the result. Note that in these figures, the composition of the α phase in the (α+γ)-Fe two phase region is denoted by α/(α+γ) while the composition of the γ phase is denoted by γ/(α+γ). γ/(γ+θ) denotes the composition of the γ phase which is in equilibrium with cementite.

Figure 2:
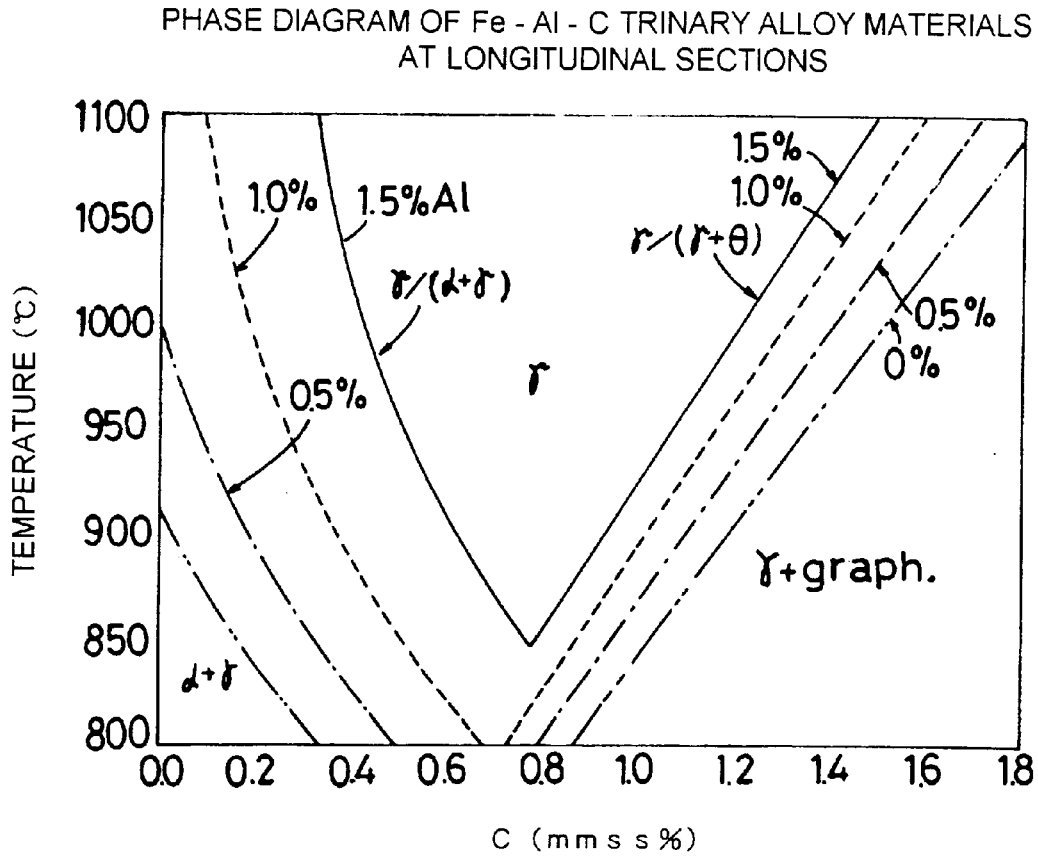
FIG. 2 is a phase diagram showing the states of Fe—Al—C. trinary alloy materials at their respective longitudinal sections.
Figure 3:
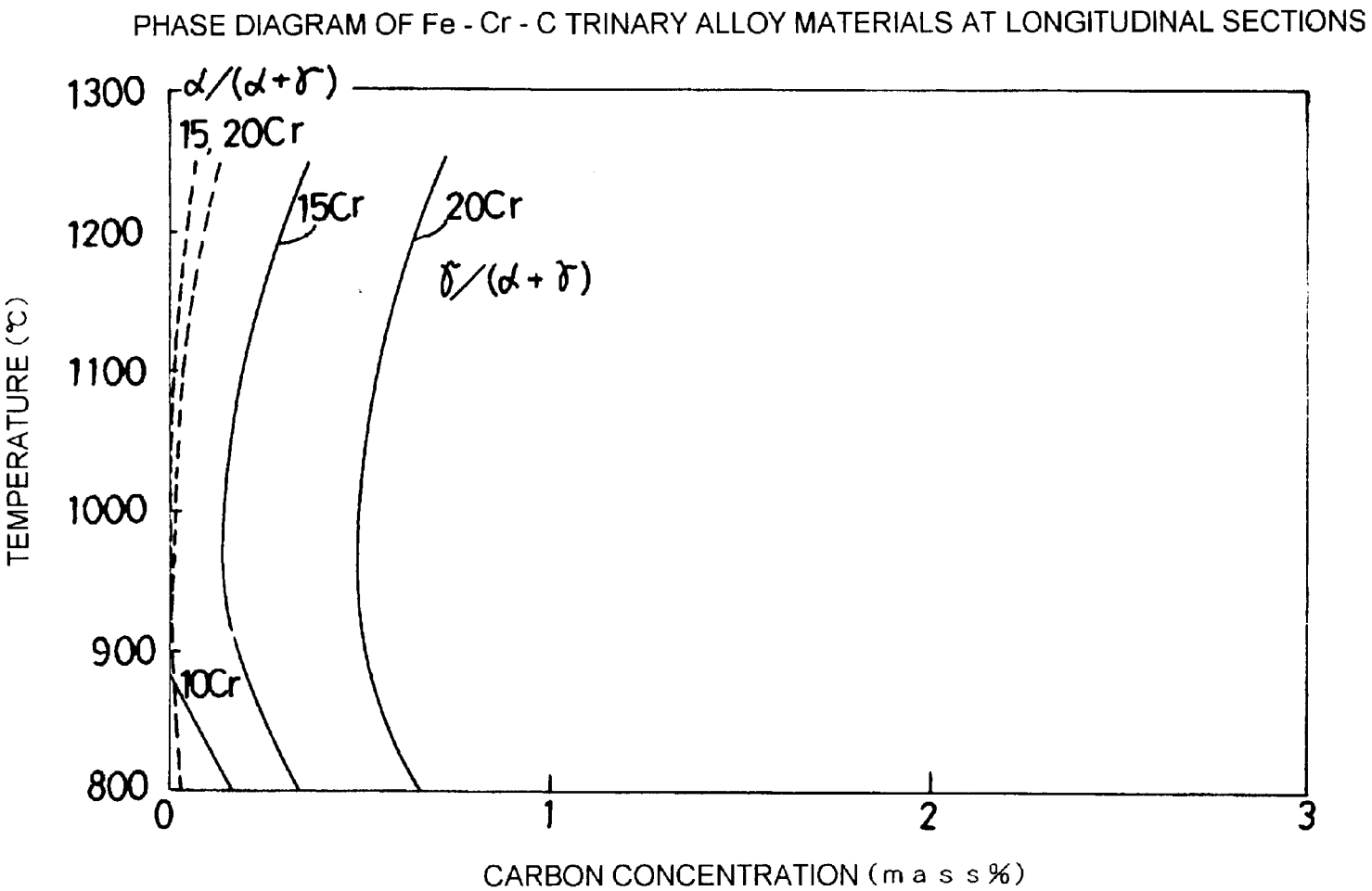
FIG. 3 is a phase diagram showing the states of Fe—Cr—C. trinary alloy materials at their respective longitudinal sections.
Figure 4:
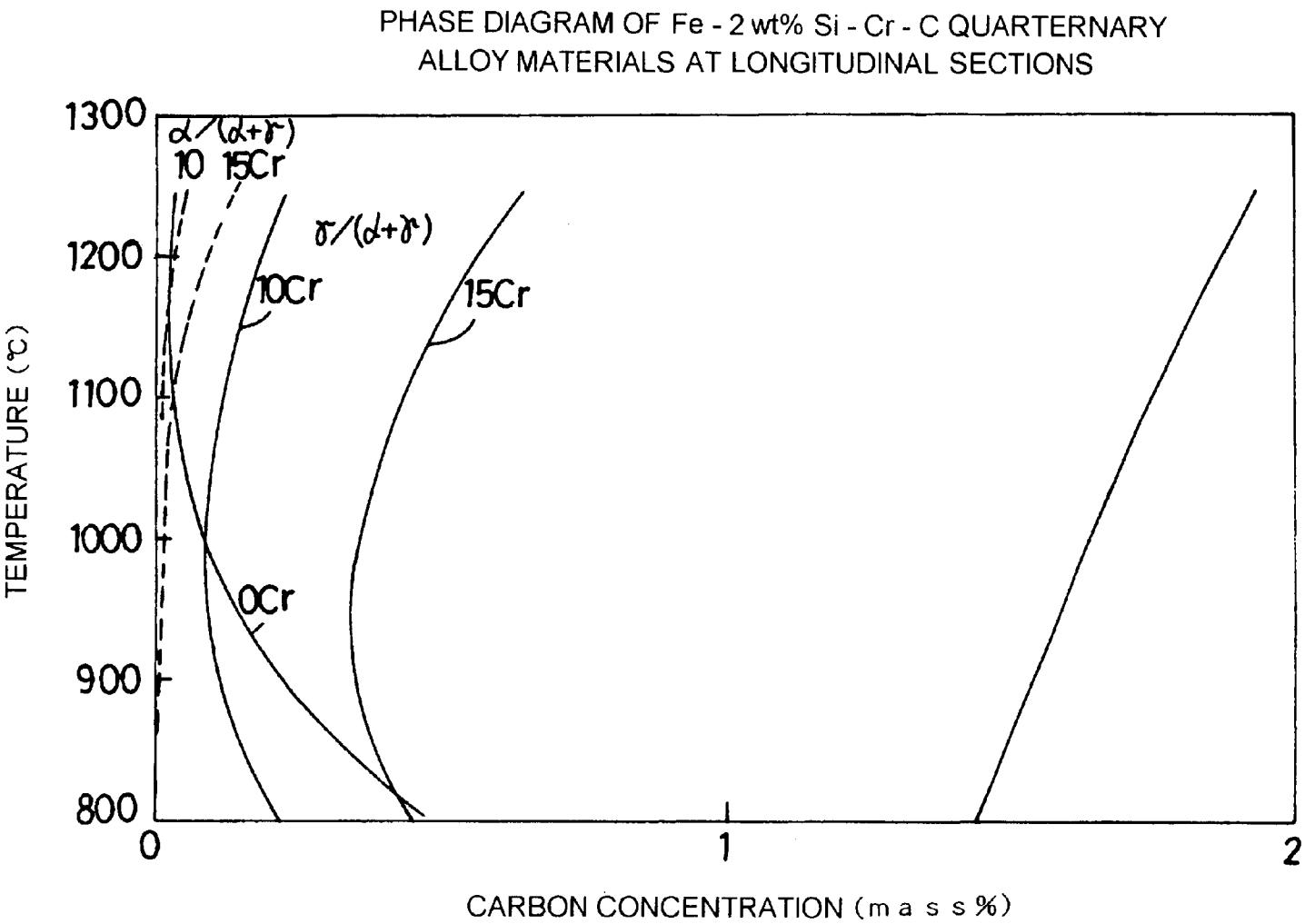
FIG. 4 is a phase diagram showing the states of Fe-2 wt % Si—Cr—C quarternary alloy materials at their respective longitudinal sections.
Figure 5:
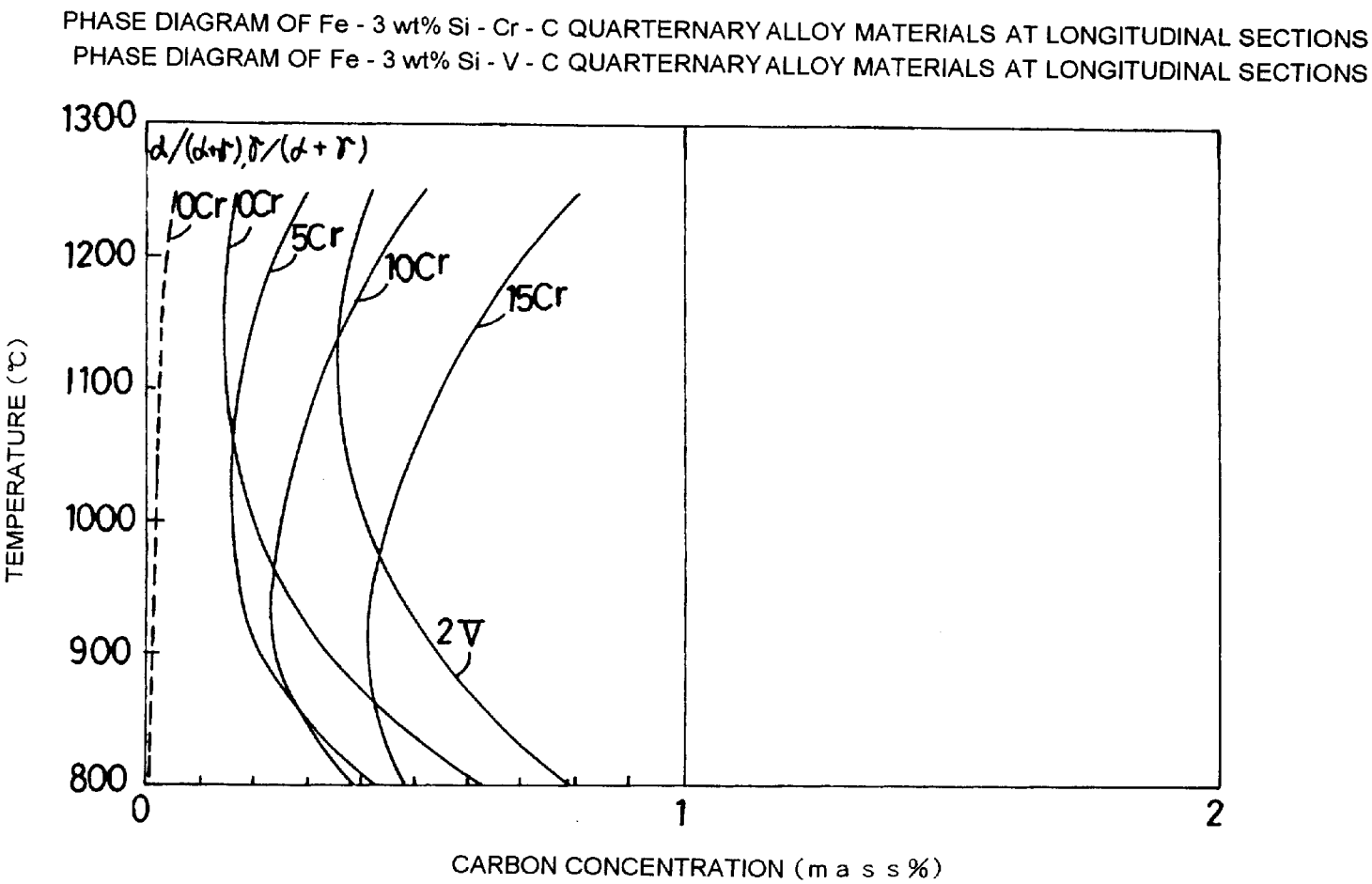
FIG. 5 is a phase diagram showing the states of Fe-3 wt % Si—Cr—C quarternary alloy materials and Fe-3 wt % Si—V—C quarternary alloy materials at their respective longitudinal sections.
Figure 6:
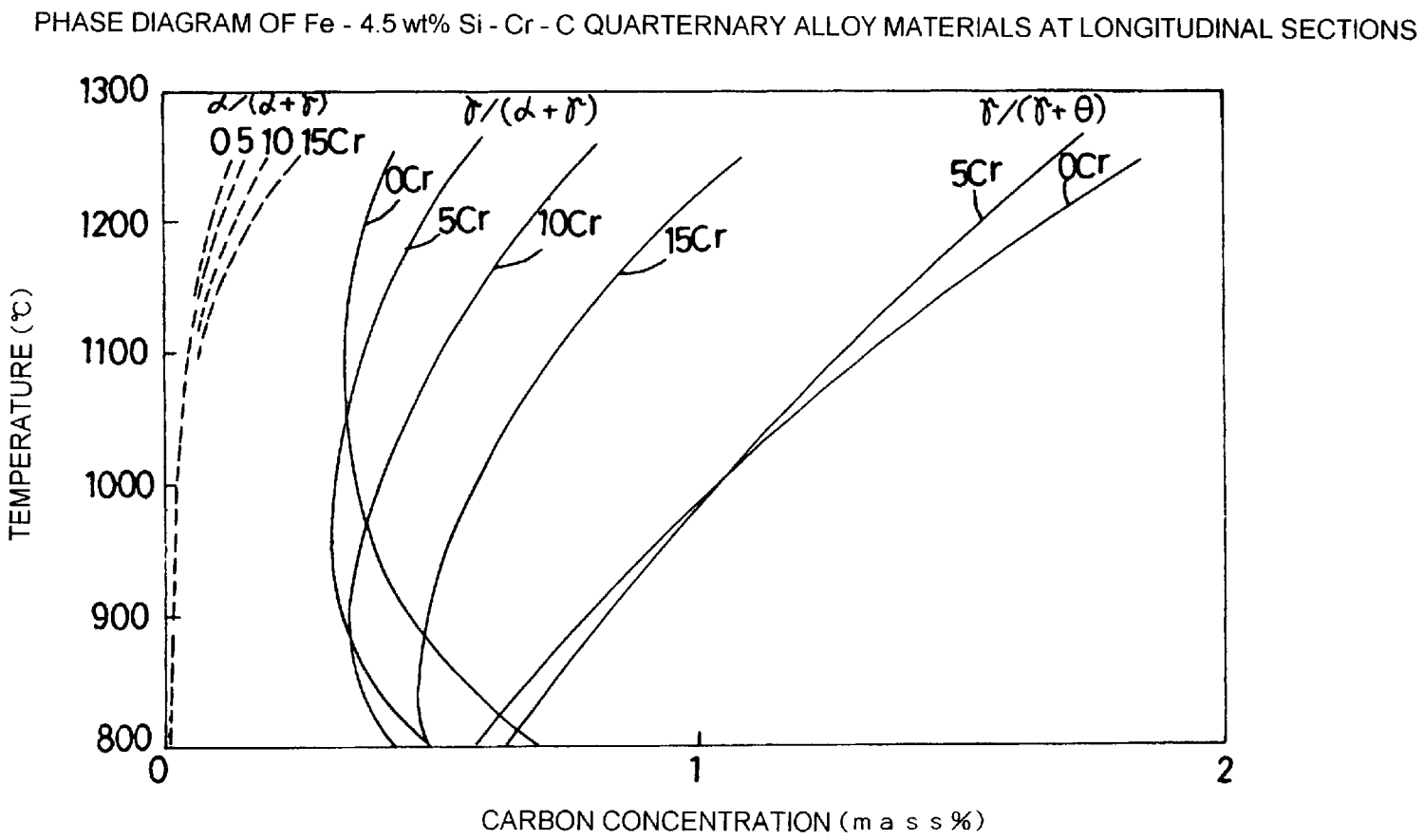
FIG. 6 is a phase diagram showing the states of Fe-4.5 wt % Si—Cr—C quarternary alloy materials at their respective longitudinal sections.

FIGS. 1 and 2 show the states of Fe—Si—C and Fe—Al—C trinary alloy materials (the basic materials of the invention), respectively at their longitudinal sections. It is understood from these figures that when Si is added in an amount of about 2 wt % or more or Al is added in an amount of 0.7 wt % or more, the (α+γ)-Fe two phase region stably exists in a wider range of carbon concentration (wt %) in the temperature range of 800° C. or more, and that in this temperature region, deformation resistance considerably decreases in plastic working owing to the presence of the α phase and therefore excellent plastic workability can be achieved.

Since the material rapidly becomes brittle when 5 wt % or more of Si is contained in Fe—Si dual alloys, the upper limit of the amount of Si to be added is determined to be 4.5 wt % in the invention. Al has the substantially same functions as Si, but is not practical for use in steel making because when a large amount of Al is added, inclusions are apt to be caught or generated. Therefore, the total amount of Si and Al contained in the steels of the invention does not exceed 4.5 wt %. As discussed earlier, in order to dispersedly precipitate AlN in carbonitriding of gears to achieve increased surface pressure bearing strength, the amount of Al is determined to be within the range of from 0.1 to 1.5 wt %. In this case, the amount of carbon is 0.35 wt % or less at the point of A in FIG. 1. When taking plastic workability into account, the α phase at the time of occurrence of plastic deformation is preferably 25% by volume or more and therefore carbon content is more preferably 0.25 wt %. But, carbon content is determined to be 0.35 wt % or less in the invention in view of the fact that the (α+γ)-Fe two phase region is allowed to extend, covering the higher carbon concentration region by combined addition of alloy elements such as Mo, Cr and V. Regarding the lower limit of the amount of Si, although the (α+γ)-Fe two phase region can be increased by addition of Cr and V as seen from FIGS. 3, 4, 5 and 6 and the amount of Si to be added can be reduced by addition of Al which has the substantially same effects as Si, it is preferable to effectively use inexpensive Si as much as possible.

Cr and V do not form an intermetallic compound combining with Fe and are capable of strongly bonding with carbon and nitrogen unlike Si. Further, they effectively enlarge and stabilize the (α+γ)-Fe two phase region as seen from FIG. 5, and especially Cr does not increase plastic deformation resistance in hot forming. Therefore, it is thought to be effective to add these elements up to 15 wt % in view of cost. In consideration of cost and the fact that the effect substantially similar to that of 15 wt % Cr may be obtained by adding V in an amount of 2 wt %, the preferable upper limit for V is 2 wt %.

Figure 7:
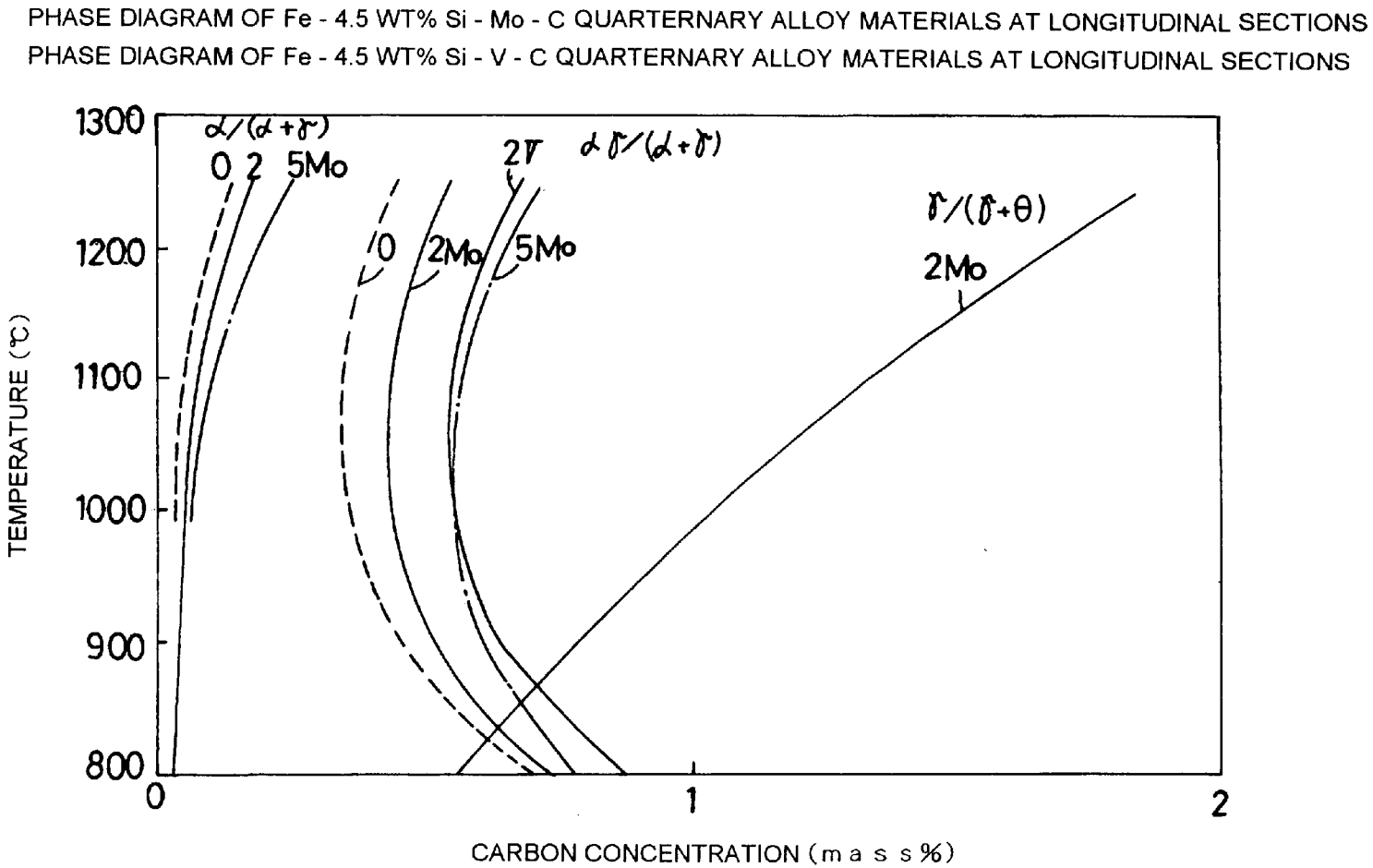
FIG. 7 is a phase diagram showing the states of Fe-4.5 wt % Si—Mo—C quartemary alloy materials and Fe-4.5 wt % Si—V—C. quarternary alloy materials at their respective longitudinal sections.

FIG. 7 shows the effects of Mo and V for increasing the (α+γ)-Fe two phase region, and it is obvious from this figure that the effect of Mo is small compared to V and others. Therefore, the upper limit of Mo is preferably 1.0 wt %, in view of cost and the purpose for ensuring hardenability after the aforesaid carburization, carbonitriding and nitriding.

Figure 8:
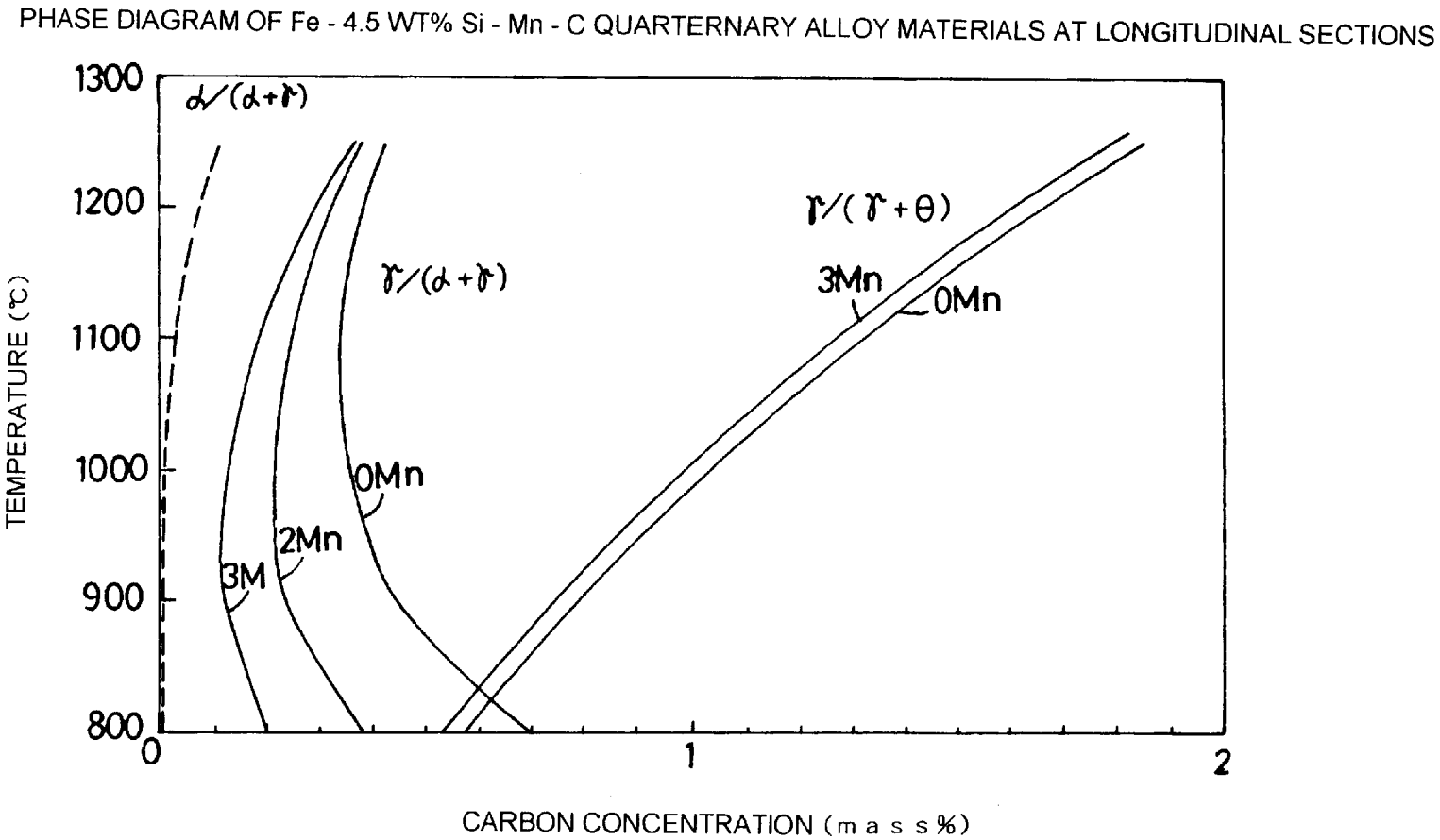
FIG. 8 is a phase diagram showing the states of Fe-4.5 wt % Si—Mn—C quarternary alloy materials at their respective longitudinal sections.
Figure 9:
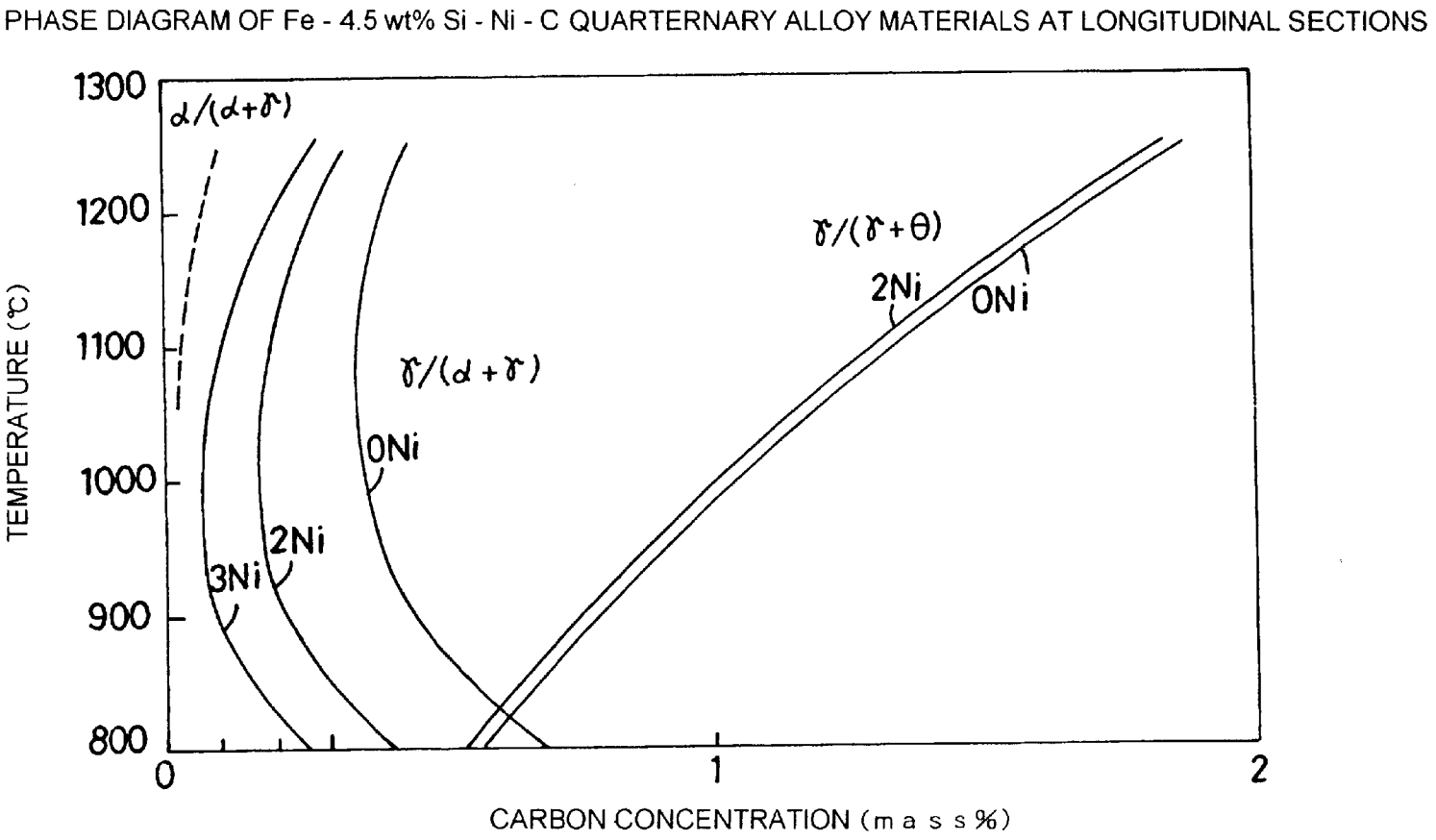
FIG. 9 is a phase diagram showing the states of Fe-4.5 wt % Si—Ni—C quarternary alloy materials at their respective longitudinal sections.
Figure 10:
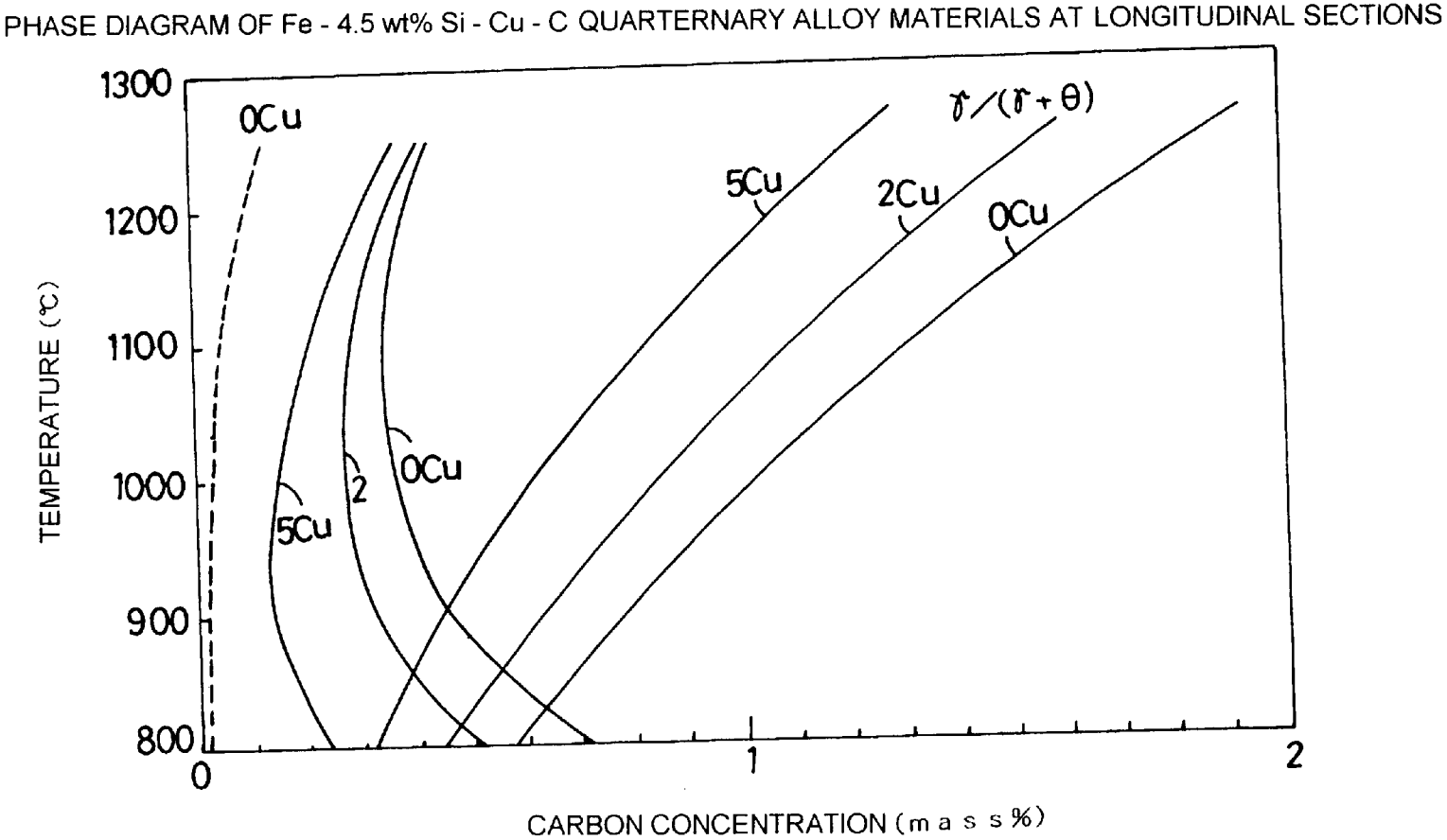
FIG. 10 is a phase diagram showing the states of Fe-4.5 wt % Si—Cu—C. quarternary alloy materials at their respective longitudinal sections.

FIGS. 8, 9 and 10 show the effects of Mn, Ni and Cu. Since these elements reduce the (α+γ)-Fe dual phase region, addition of large amounts of them should be avoided. Therefore, the respective amounts of Mn, Ni and Cu are preferably 3 wt % or less.

The compositions of sample steels prepared based on the above-described design conditions and a comparative sample are shown in TABLE 1.

TABLE 1

| No | C | Si | Mn | Cr | Mo | Al | V |
|---|---|---|---|---|---|---|---|
| 1 | 0.13 | 3.42 | 0.51 | 0.32 | 0.25 | 0.21 | |
| 2 | 0.25 | 4.51 | 1.22 | 0.55 | 0.15 | 0.47 | |
| 3 | 0.14 | 3.01 | 1.15 | 1.51 | 0.16 | 1.03 | |
| 4 | 0.21 | 3.21 | 0.71 | 12.1 | | 0.11 | 0.41 |
| 5 | 0.12 | 2.03 | 0.48 | 0.71 | 0.16 | 0.51 | 0.83 |
| COMPARATIVE MATERIAL | 0.15 | 0.21 | 0.68 | 1.02 | 0.16 | 0.03 | |

[2] Forging Test

Figure 11:
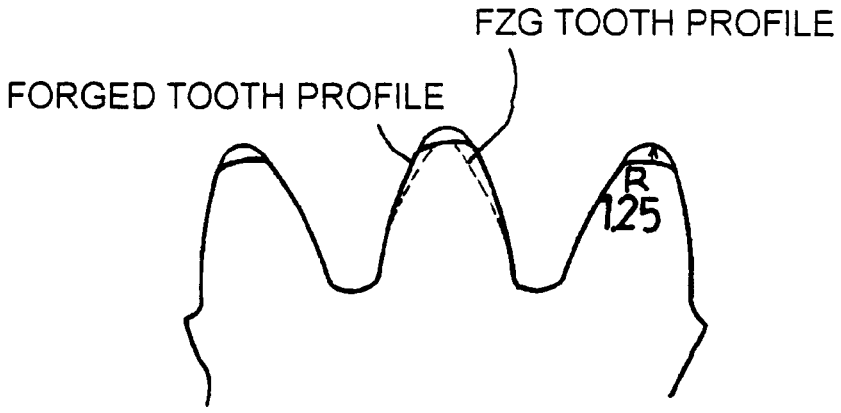
FIG. 11 is a schematic view of a forged gear.
Figure 12:
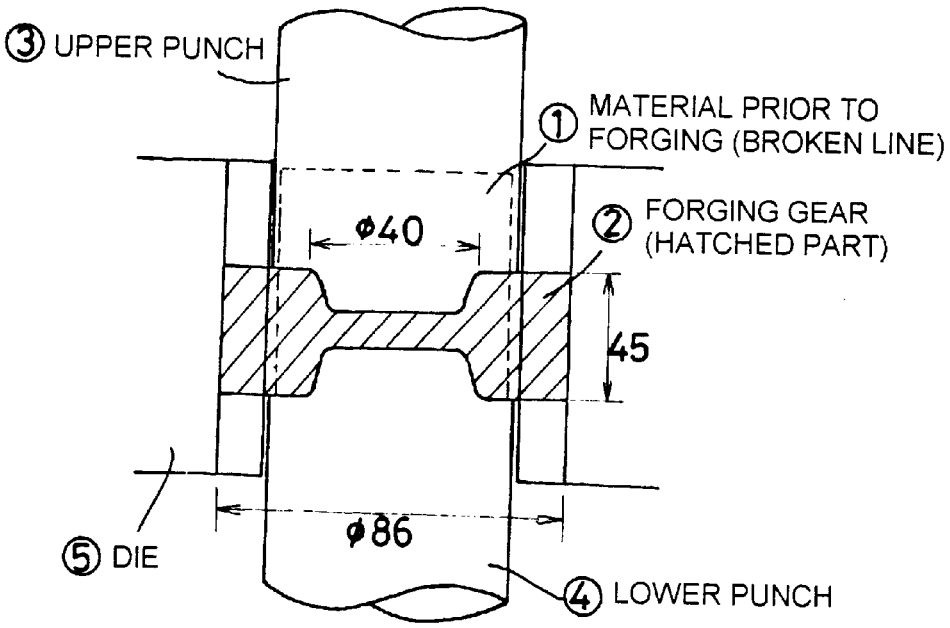
FIG. 12 illustrates a gear material prior to forging and a forging method.
Figure 14:
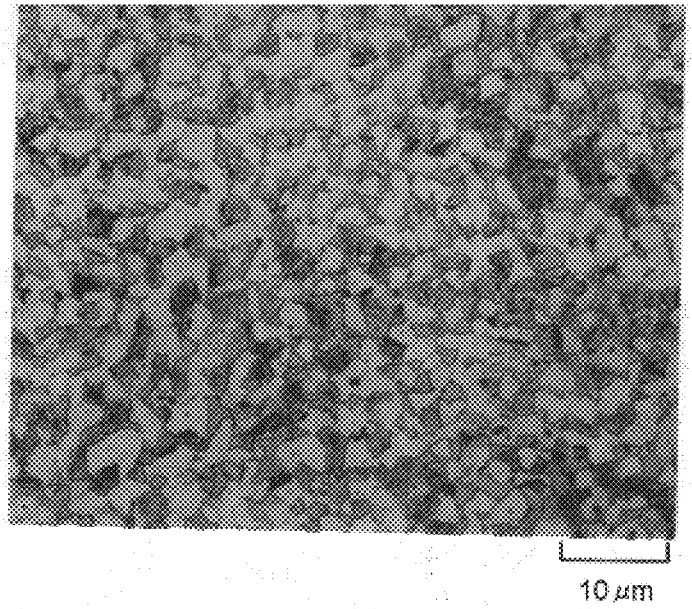
FIG. 14 shows the metallographic structure of the crystal grains of a material No. 1 obtained after heating at 1,100° C. for one hour.

As shown in FIG. 11, a blank used in the forging test has a large round part (R=1.25 mm) at each tip in order that gears (shown in FIG. 13(*a*)) to be used in a power circulating gear testing machine (hereinafter referred to as "FZG") can be taken out therefrom. In forging, a 500 ton hydraulic press was used. A material piece before forging had a cylindrical shape as indicated by numeral ④ in FIG. 12. The material was thin coated with a graphite lubricant and subjected to high-frequency heating at 1,000° C. Then, teeth were formed while upsetting the material as shown in FIG. 12. The forging test was conducted on the steel material No. 3 shown in TABLE 1. After forging, the precision of each gear was evaluated by measuring the diameter of a tooth tip at the center of a tooth and at the positions±20 mm away from the center. The result is shown in TABLE 2. As obvious from TABLE 2, the material No. 3 has superior formability to the comparative sample of SCM 418. Further, the material No. 3 is free from short shots to the tips and the molding pressure required by No. 3 is about one half of that required by the comparative sample. FIG. 14 shows the metallographic structure of the material No. 1 obtained by hardening after heating at 1,100° C. for one hour. It is seen from this figure that the crystal grains are in a fine state.

TABLE 2

RESULT OF FORGING TEST (AVERAGE RESULT WITH GEAR TIP OUTER DIAMETER n = 20)

| | UPPER PORTION | | CENTER AVERAGE | | LOWER PORTION | |
|---|---|---|---|---|---|---|
| | AVERAGE | 3σ | | 3σ | AVERAGE | 3σ |
| No. 3 | 86.15 | 0.055 | 86.17 | 0.045 | 86.16 | 0.052 |
| COMPARATIVE MATERIAL | 84.92 | 0.213 | 85.93 | 0.132 | 85.03 | 0.178 |

[3] Heat Treatment

The gear material pieces were machined into the shape shown in FIG. 13(*a*) and then underwent a carburization and carbonitriding test.

(1) Carburization/carbonitriding test 1

Figure 15:
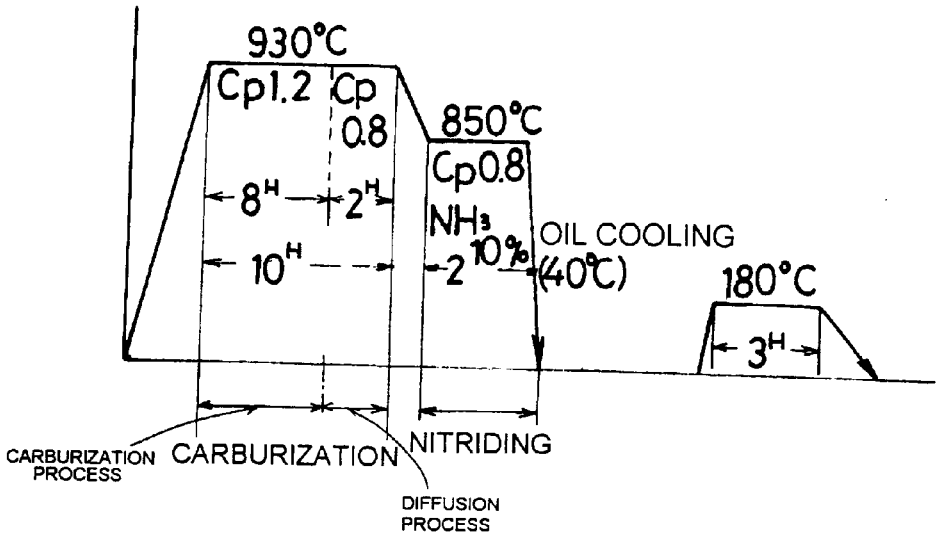
FIG. 15 shows a heat treatment pattern adapted in a carburization and carbonitriding test 1.

After applying heat treatment to the samples in an RX gas carburizing furnace according to the pattern shown in FIG. 15, the heat distortion of each gear was inspected by checking each tooth profile. TABLE 3 shows the result. It is obvious from this table that the gears of the invention have less distortion compared to the comparative sample.

TABLE 3

RESULT OF HEAT TREATMENT DISTORTION TEST

| No | TOOTH PROFILE DISTORTION (μm) |
|---|---|
| 1 | 7.7 (3σ = 1.45) |
| 2 | 6.4 (3σ = 1.38) |
| COMPARATIVE MATERIAL | 18.2 (3σ = 3.1) |

The purpose of carbonitriding at 850° C. is to finely precipitate the nitrides and carbonitrides of Al, Cr and V in the surface phase of the gears. It was confirmed that in the carburization process at 930° C., Cr carbide "Cr7C3" having an average particle diameter of about 0.2μwas finely precipitated in the material No. 4 (see TABLE 1) which contains a high concentration of Cr. It should be noted that since a considerable amount of plate-like carbide was precipitated in the grain boundary when the furnace is cooled from 930° C. to 850° C. in heat treatment with the pattern shown in FIG. 15, it is necessary to once carry out rapid cooling after the carburization in order to prevent the precipitation of the plate-like carbide. This is applicable as well to the case of the material No. 5 containing a high concentration of V.

In order to promote the dispersion/precipitation of nitrides in nitriding, higher nitriding temperatures of 950° C. and 1,000° C. were adapted. When nitriding temperature was 1,000° C., voids attributable to nitrogen gas were created in the phase of the outermost surface. It is found from this result that the nitrogen diffusion permeation treatment by use of ammonia crack gas should be carried out at a temperature of less than 1,000° C., and more preferably at a temperature of 950° C. or less.

Figure 16:
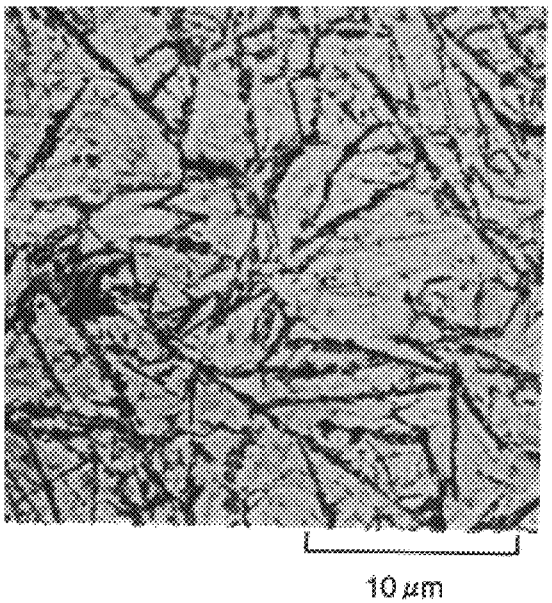
FIG. 16 shows the metallographic structure of the surface of a material No. 3 to which the heat treatment shown in FIG. 15 has been applied.

FIG. 16 shows the metallographic structure of the surface layer of the material No. 3 from which it is understood that the needle-like martensite plate is fine and irregular because of the precipitating AlN and a high concentration of residual austenite is created. The amount of residual austenite has been found by the X-ray analysis to be about 49% by volume. FIGS. 17(*a*) and 17(*b*) show the metallographic structures of the material No. 3 observed at the surface layer and at the region having a depth of 400 μm from the surface respectively, using a scan-type electron microscope in a roller pitting test (described later). It is understood from these figures that further martensite created from the residual austenite in the surface layer are fined to a considerable extent owing to the dense dispersed precipitation of AlN having an average particle diameter of 0.2 μm or less.

The residual austenite remains in an amount of 20 to 30% by volume or more after conducting the roller pitting test described later, and the residual austenite of the comparative material is reduced from 50 to 60% by volume to about 5 to 7% by volume after rolling. It is understood from this that the fine precipitant such as AlN significantly stabilizes the residual austenite, which highly contributes to improved surface pressure bearing strength.

(2) Carburization and carbonitriding test 2

Figure 18:
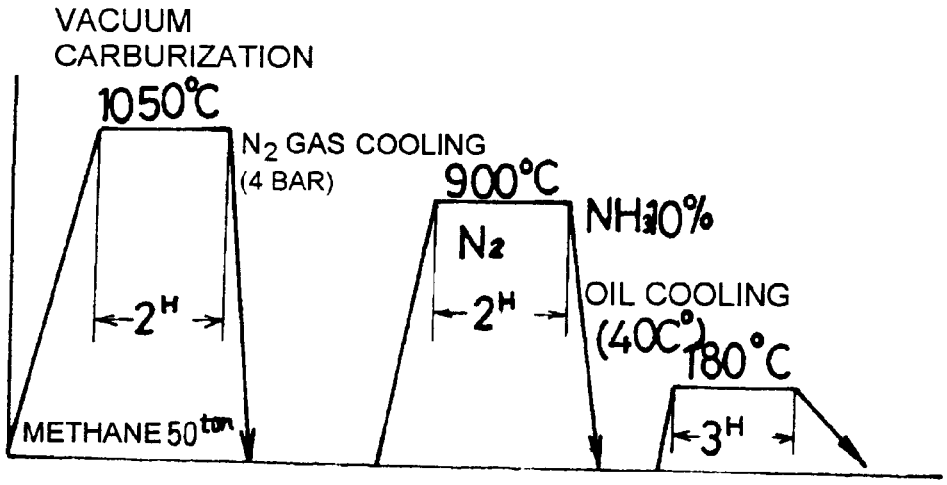
FIG. 18 shows a heat treatment pattern adapted in a carburization and carbonitriding test 2.

After carburizing with the pattern shown in FIG. 18 using a vacuum carburizing furnace, the samples were subjected to gas cooling and then to nitriding at a temperature of 850° C. This process is thought to be essential for steels containing large amounts of Cr and V for the reasons explained above. The vacuum carburization was carried out with a carbon activity of approximately 1 which is equivalent to a carbon potential of about 1.7 wt %. This carburization did not involve a diffusion process which was usually performed in conventional carburizing cycles but involves only a carburizing process.

Figure 19:
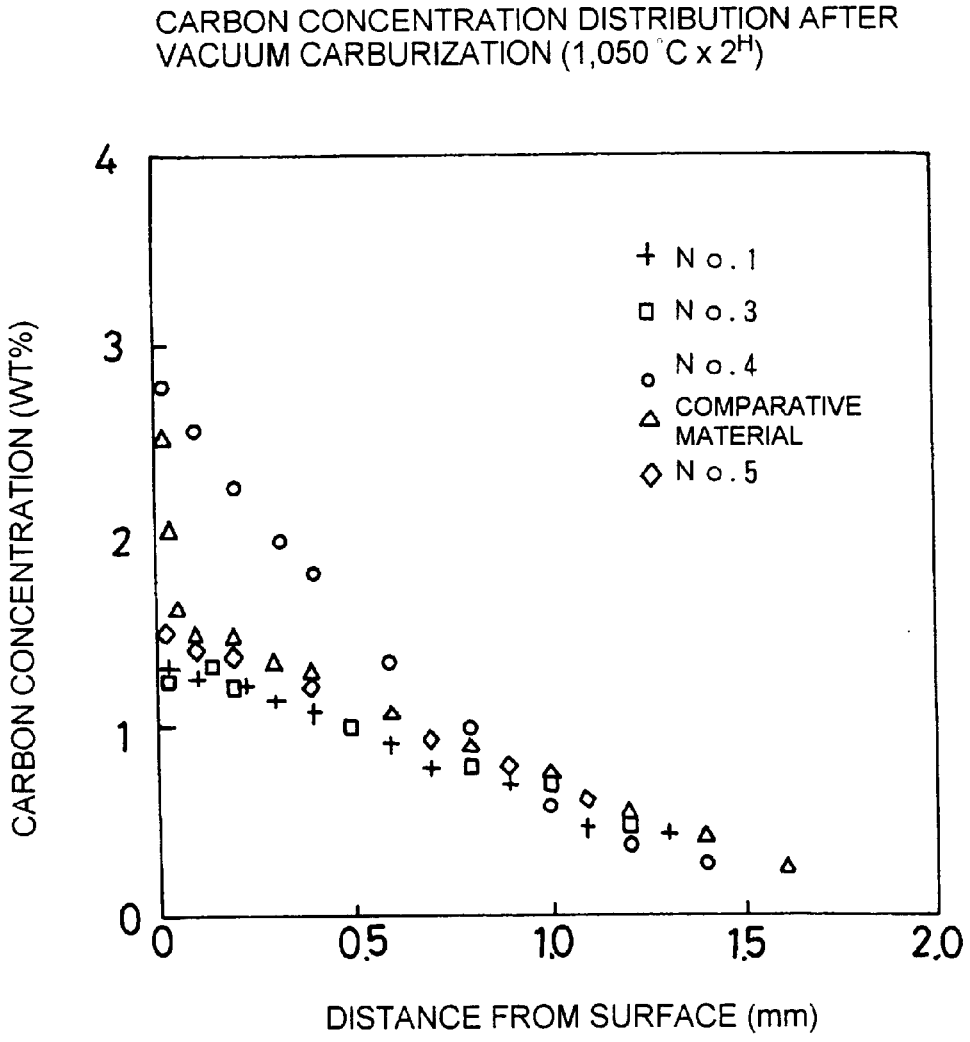
FIG. 19 shows the distributions of carbon concentration at the surface layers of materials Nos. 1, 3 and 4 and a comparative material after vacuum carburization.
Figure 20:
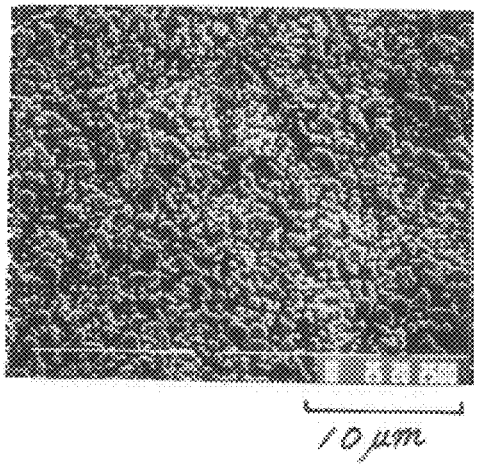
FIG. 20 shows the metallographic structure of the material No. 4 obtained after carburization at 1,050° C. according to the pattern shown in FIG. 18.

FIG. 19 shows the distribution of surface carbon concentration of the samples after the vacuum carburization. As seen from FIG. 19, while significant carbon concentration due to precipitation of coarse cementite is admitted in the comparative material, precipitation of coarse cementite is prevented in the materials Nos. 1 and 3 of the invention. Carbon concentration slightly higher than those of the materials No. 1 and 3 is caused by the addition of V in the material No. 5. Considerable carbon concentration due to Cr7C3 carbide can be admitted in the material No. 4. FIG. 20 shows the metallographic structure of the material No. 4 observed in the vicinity of the outermost surface layer after the carburization/cooling. As stated above, it is seen from this figure that extremely fine Cr carbide is uniformly, densely dispersed and precipitated but coarse cementite precipitation is prevented.

The method of this embodiment saves considerable carburization cost and is very useful as a means for increasing surface pressure bearing strength as described later, in which rapid carburization is carried out without a substantial diffusion process by use of a steel material which does not cause coarse cementite precipitation even under the conventional carburizing conditions (carburization temperature=930° C., carbon potential=1.2 wt % or more and carbon activity=about 1), and after the material is once cooled, reheating hardening or carbonitriding hardening is carried out to precipitate fine carbides, nitrides and carbonitrides, thereby increasing surface pressure bearing strength.

The material No. 4, which is designed such that precipitation of coarse cementite during carburization is completely prevented by adding Si and Al in an amount of 1.5 wt % or more and Cr in an amount of less than 4 wt % and when the amount of Cr is 4 wt % or more, cementite does not precipitate but fine Cr carbide (Cr7C3 type) precipitates, is a preferable material in view of improvements not only in rolling strength but also in wear resistance.

The distribution coefficient of V present between the Cr7C3 carbide which precipitates in carburization and the austenite was measured. It is found from the measurement that V is markedly concentrated in the Cr7C3 carbide in an amount of about 15 wt % that is equal to the concentration of V in the austenite matrix. Where the Cr7C3 carbide which precipitates in carburization is further fined by addition of 15 wt % (upper limit) of Cr thereby providing excellent surface pressure bearing characteristics at the surface layer, the effective maximum amount of V is obtained from approximation in the following way.

(1) About 35% by volume of Cr7C3 precipitates.

(2) The distribution coefficient of V is 15, from which the concentration of V in the matrix of austenite can be obtained.

(3) The carbon concentration of austenite which is in equilibrium with the Cr7C3 carbide approximates about 1 wt %. From the solubility limits of V and C, the maximum concentration of V soluble in austenite is determined to be about 0.35 wt %. Accordingly, it is determined that V can be added in an amount of about 1.8 wt % as an alloy element for steel. If the amount of V exceeds this amount, excessive V is further precipitated in the form of VC. This figure coincides with the above-mentioned amount of V that is appropriate for increasing the ($\alpha+\gamma$)-Fe two phase region and therefore the upper limit of the amount of V used in the invention is determined to be 2 wt % or less.

[4] Evaluation of Surface Pressure Bearing Strength (1) Roller pitting test

After sample steels were respectively formed into small roller specimens as shown in FIG. 21(*a*), the specimens made of the materials Nos. 1, 2 and 3 and the comparative material underwent the heat treatment shown in FIG. 15. The heat treatment shown in FIG. 18 was further applied to the specimens made of the materials Nos. 4 and 5 and a surface pressure test was then made. For preparing large roller specimens to be used in the roller pitching test, SUJ2 was quenched and tempered so as to have a hardness of $H_{RC}64$.

In the test, rotational speed was 1,050 rpm, slip factor was 40% and surface pressure was appropriately varied within the range of 250 to 375 kg/mm$^2$. EO30 was used as a lubricant and oil temperature was adjusted to 80° C. An occurrence of pitting was determined on the basis of the number of rotations of a small roller.

Figure 22:
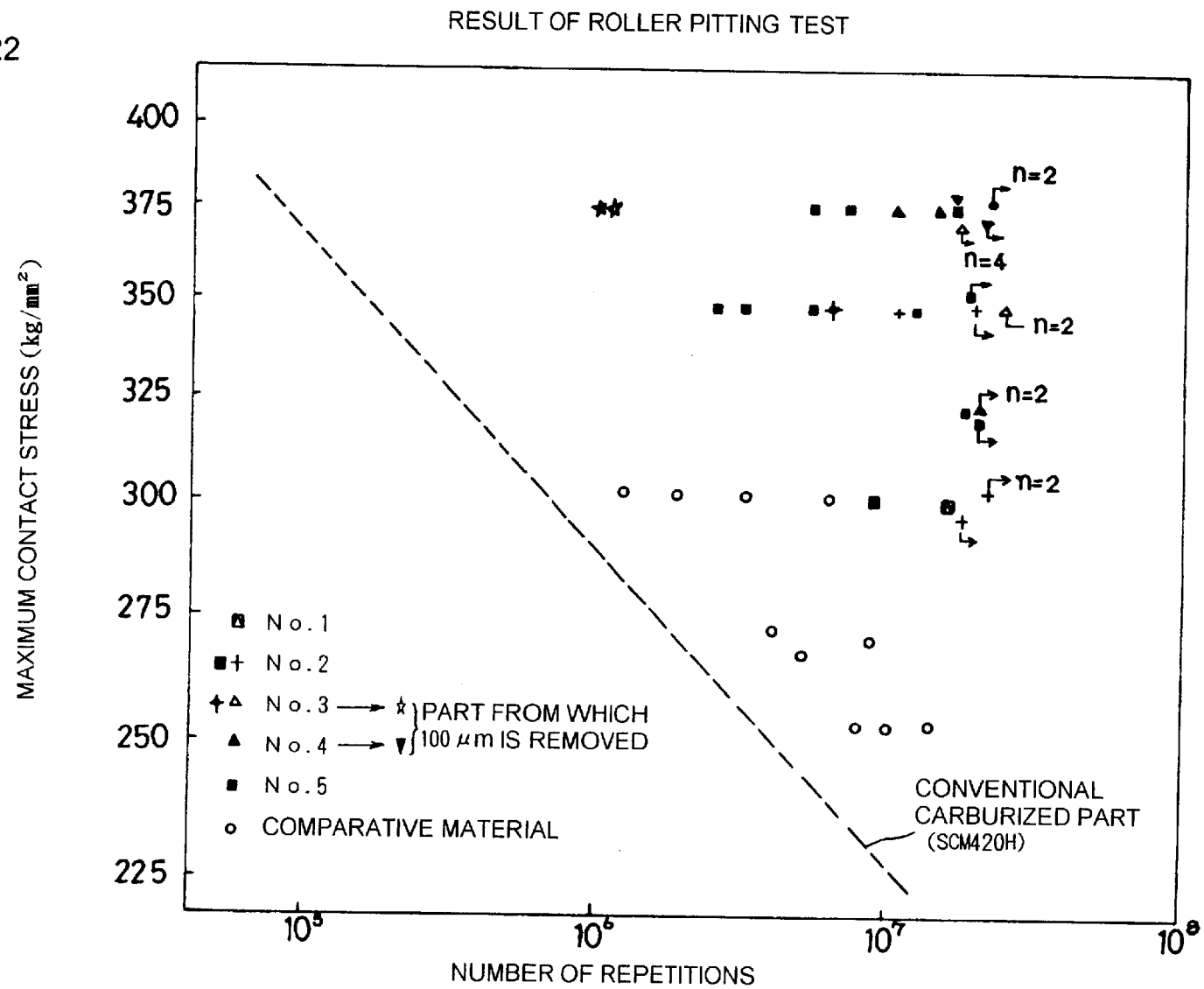
FIG. 22 is a graph showing the result of the roller pitting test.

FIG. 22 shows the result of the test made under the above-described conditions. It should be noted that marks ☆ and ▼ designate the cases where small rollers made of the materials No. 3 and No. 4 were used. In these rollers, about 100 $\mu$m was removed respectively from their surfaces. It is understood from the result that the roller made of No. 3 considerably deteriorated in surface pressure bearing strength.

From the comparison among the materials Nos. 1, 2, 3, 5 and the comparative material, it is found that surface pressure bearing strength increases with the amount of Al up to about 1 wt % Al and this is due to the effect of the precipitation of fine Al. In the case of the material No. 4 containing a large amount of Cr, improved bearing strength is largely attributable to the dispersed precipitation of about 20% by volume of fine Cr special carbide rather than the addition of AlN.

(2) Power circulating gear test

The material No. 3 and comparative material were evaluated in terms of surface pressure and gear strength at the dedendum, using a power circulating gear testing machine (FZG). The gears used as a counterpart in the FZG test have the design shown in FIG. 13(*b*) and were prepared by applying the same heat treatment to the same material. In the FZG test, rotational speed was 2,000 rpm and the surface pressure on the gears was appropriately varied within the range of from 200 to 300 kg/mm$^2$. An occurrence of pitting was determined based on the number of intermeshed teeth obtained when vibration caused by pitching is detected. In practice, more than two times of pitching were observed in a gear when such vibration occurred. The lubricant used herein was EO30 and oil temperature was adjusted to 80° C.

The gears did not fracture from their dedendums before and after an occurrence of pitting, so that they proved to have no problem in dedendum strength.

Figure 23:
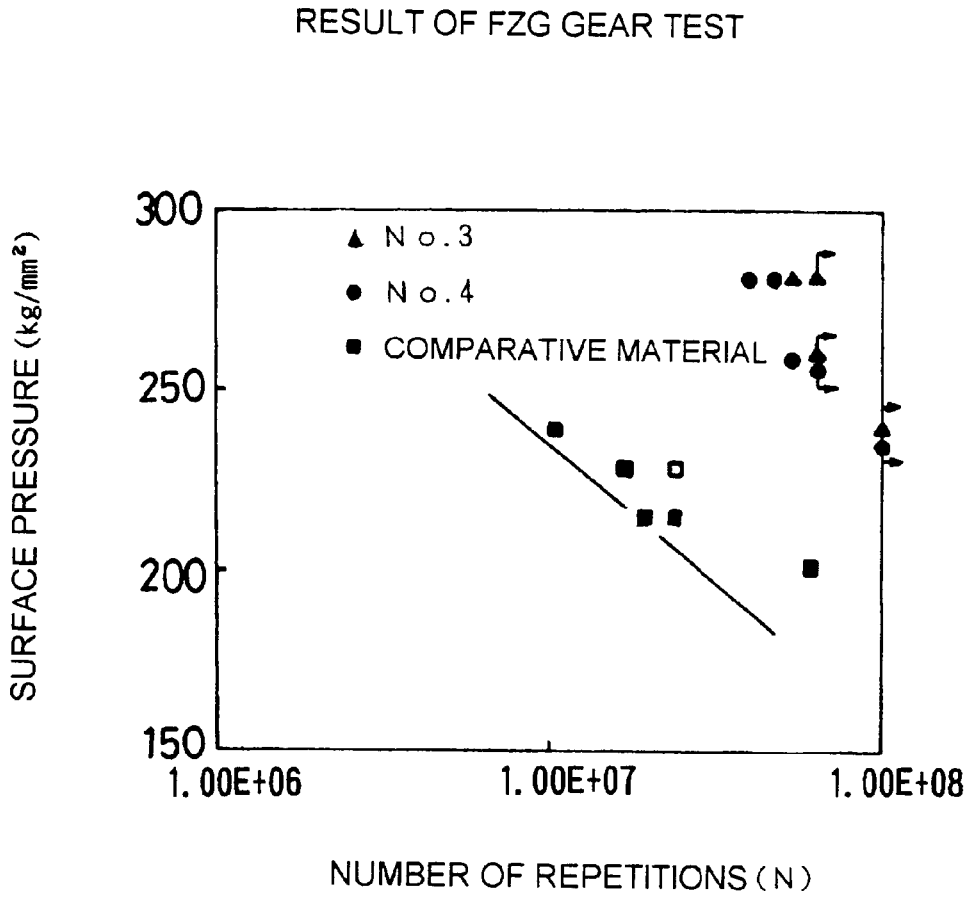
FIG. 23 is a graph showing the result of the power circulating gear test.

The result of the surface pressure bearing strength test conducted on the material No. 3 and the comparative material is shown in FIG. 23. It is understood from FIG. 23 that surface pressure bearing strength can be significantly improved by addition of Al. This conforms well to the result of the above-described roller pitting test.

According to the invention, gear material excellent in plastic workability can be easily obtained, which highly contributes to labor savings in the subsequent step of machining. In addition, gears and various rolling elements having excellent surface pressure bearing strength can be produced by dispersion of fine AlN and Cr carbides and fining of martensite. Further, precipitation of coarse cementite can be prevented by addition of Si and Al even if carburization is carried out under high carbon potential condition with a carbon activity of substantially 1. This enables rapid carburization, leading to savings in the cost of the heat treatment applied to gears and other rolling elements.

What is claimed is:

1. A method for producing a rolling element which has a surface layer mainly composed of martensite, residual austenite, carbide such as cementite having an average grain size of 3 μm or less and no α-Fe phase (ferrite) and which has an inner structure of an (α+γ)-Fe two phase region, said method comprising cooling steel material from the austenitic range to form an (α+γ)-Fe two phase inner structure, forming a rolling element by plastic working said steel material at a temperature in the range of 800–1300° C., applying one or more types of heat treatment selected from carburization, carbonitriding and nitriding to said rolling element, cooling said rolling element, then applying a reheating hardening process to said rolling element, said steel material containing: at least 1.0 to 4.5 wt % Si and Al in total; 0.35 wt % or less C; and balance Fe and unavoidable impurities, wherein said Al and Si function to reduce deformation resistance in said plastic working for forming the steel material into a rolling element by widening the range of heating temperature for an α-Fe phase region or (α+γ)-Fe two phase region to at least 800° C. to 1,300° C., and to prevent precipitation of coarse cementite in the rolling surface of the rolling element, even if carbon potential is 1.2 wt % or more in the carburization and/or carbonitriding heat treatment which is carried out for the purpose of increasing the strength of the rolling element.

2. A rolling element producing method according to claim 1, wherein said steel material contains Al which functions to increase the (α+γ)-Fe two phase region like Si in such an amount that falls within the range of 0.2 to 1.5 wt % and wherein 0.4 to 6.0% by volume of AlN having an average grain size of 0.5 μm or less is finely, dispersedly precipitated from Al and nitrogen which has been diffused and permeated in the surface layer of the roller element by carbonitriding and/or nitriding, whereby the surface pressure bearing strength of the rolling element is increased.

3. A rolling element producing method according to claim 1, wherein said steel material contains Cr, which increases the (α+γ)-Fe two phase region like Si and Al, in an amount of 0.3 to 15 wt % to thereby ensure hardenability and prevent precipitation of graphite particles, and wherein fine Cr carbides, Cr nitrides and/or Cr carbonitrides having an average grain size of 1 μm or less are finely, dispersedly precipitated in an amount up to 35% by volume from carbon and/or nitrogen which have been diffused and permeated in the surface layer of the rolling element by one or more kinds of heat treatment selected from carburization, carbonitriding and nitriding whereby the surface pressure bearing strength of the rolling element is increased.

4. A rolling element producing method according to claim 3, wherein carbides, nitrides and carbonitrides mainly composed of Al and Cr are finely, dispersedly precipitated by carburization, carbonitriding and nitriding, and wherein the concentration of nitrogen in the surface is increased to 0.4 wt % or more, thereby creating 20 to 70% by volume of residual austenite.

5. A rolling element producing method according to claim 2, wherein said steel material contains 2 wt % or less V which increases the (α+γ)-Fe two phase region similarly to Si and Al and promotes fining of the Cr carbides.

6. A rolling element producing method according to claim 4, wherein reheating hardening is applied to the surface layer where fine precipitates are dispersed by carburization, carbonitriding or nitriding, thereby fining prior austenite so as to have a grain size of ASTM No. 9 or more, and wherein acicular martensite is formed by hardening so as to have an average width of 1 μm or less and significantly irregular linear shape.

7. A rolling element producing method according to claim 2, wherein said steel material contains one or more components selected from the group consisting of: (i) 0.1 to 3.0 wt % Mn; (ii) 0.1 to 3.0 wt % Ni; (iii) 0.1 to 3.0 wt % Cu; and (iv) 0.01 to 1.0 wt % Mo and/or B in the conventional range, and wherein the total amount of Mn, Ni and Cu is adjusted to 3 wt % or less.

8. A rolling element producing method according to claim 1, wherein the depth of the region where carbon is diffused and permeated by the carburization and/or carbonitriding is (module M×0.15) mm or more from the surface, in cases where the rolling element is a gear.

9. A rolling element producing method according to claim 2, wherein the depth of the region where nitrogen is diffused and permeated by the carbonitriding and/or nitriding thereby dispersedly precipitating the nitrides is 50 μm or more from the surface.

10. A rolling element producing method according to claim 1, wherein the amount of the α-Fe phase at the plastic working temperature is 25% by volume or more in order to widen the range of heating temperature for the (α+γ)-Fe two phase region to reduce deformation resistance in the plastic working for forming the material into a substantially desired shape.

11. A rolling element produced by the method set forth in any one of claims 1 to 10.

* * * * *